US006800121B2

(12) United States Patent
Shahin

(10) Patent No.: US 6,800,121 B2
(45) Date of Patent: Oct. 5, 2004

(54) ELECTROLESS NICKEL PLATING SOLUTIONS

(75) Inventor: George E. Shahin, Rock Hill, SC (US)

(73) Assignee: Atotech Deutschland GmbH, Berlin (DE)

( * ) Notice: Subject to any disclaimer, the term of this patent is extended or adjusted under 35 U.S.C. 154(b) by 139 days.

(21) Appl. No.: 10/174,185

(22) Filed: Jun. 18, 2002

(65) Prior Publication Data

US 2003/0232148 A1 Dec. 18, 2003

(51) Int. Cl.[7] ..... C23C 18/36; B05D 1/18

(52) U.S. Cl. ..... 106/1.22; 106/1.27; 427/443.1; 427/438

(58) Field of Search ..... 106/1.22, 1.27; 427/438, 443.1

(56) References Cited

U.S. PATENT DOCUMENTS

| | | | | |
|---|---|---|---|---|
| 3,953,624 A | | 4/1976 | Arnold | 427/256 |
| 4,397,812 A | | 8/1983 | Mallory, Jr. | 420/441 |
| 4,483,711 A | | 11/1984 | Harbulak et al. | 106/1.22 |
| 5,221,328 A | | 6/1993 | Bishop et al. | 106/1.23 |
| 5,258,061 A | | 11/1993 | Martyak et al. | 106/122 |
| 5,944,879 A | * | 8/1999 | Martyak | 106/1.22 |
| 6,020,021 A | | 2/2000 | Mallory, Jr. | 427/98 |
| 6,048,585 A | * | 4/2000 | Martyak et al. | 427/443.1 |
| 6,099,624 A | | 8/2000 | Martyak | 106/1.27 |

FOREIGN PATENT DOCUMENTS

| | | |
|---|---|---|
| EP | 861 924 | 9/1998 |
| WO | 98/21381 | 5/1998 |

OTHER PUBLICATIONS

EP 03 01 3359; European Search Report mailed Nov. 14, 2003.

* cited by examiner

*Primary Examiner*—Helene Klemanski
(74) *Attorney, Agent, or Firm*—Renner, Otto, Boisselle & Sklar, LLP

(57) ABSTRACT

This invention relates to aqueous electroless nickel plating solutions, and more particularly, to nickel plating solutions based on nickel salts of alkyl sulfonic acids as the source of nickel ions. The plating solutions utilize, as a reducing agent, hypophosphorous acid or bath soluble salts thereof selected from sodium hypophosphite, potassium hypophosphite and ammonium hypophosphite. The electroless nickel plating solutions of the invention are free of added nickel hypophosphite, and free of alkali or alkaline earth metal ions capable of forming an insoluble orthophosphite.

26 Claims, No Drawings

ELECTROLESS NICKEL PLATING SOLUTIONS

TECHNICAL FIELD OF THE INVENTION

This invention relates to aqueous electroless nickel plating solutions, and more particularly, to nickel plating solutions based on nickel salts of alkyl sulfonic acids as the source of nickel ions.

BACKGROUND OF THE INVENTION

Electroless nickel plating is a widely utilized plating process which provides a continuous deposit of a nickel metal or nickel/alloy coating on metallic or non-metallic substrates without the need for an external electric plating current. Electroless plating has been described as a controlled autocatalytic chemical reduction process for depositing metals. The process involves a continuous buildup of a nickel coating on a substrate by immersion of the substrate in a suitable nickel plating bath under appropriate electroless plating conditions. The plating baths generally comprise an electroless nickel salt and a reducing agent. Some electroless nickel baths use hypophosphite ions as a reducing agent, and during the process, the hypophosphite ions are oxidized to orthophosphite ions, and the nickel cations in the plating bath are reduced to form a nickel phosphorous alloy as a deposit on the desired substrate surface. As the reaction proceeds, the level of orthophosphite ions in the bath increases, and the orthophosphite ions often are precipitated from the plating solutions as insoluble metal orthophosphites. The precipitation of insoluble orthophosphites from the plating solutions may cause "roughness" on the plated article. Typically, the source of nickel ions in the electroless plating baths described in the prior art has included nickel chloride, nickel sulfate, nickel bromide, nickel fluoroborate, nickel sulfonate, nickel sulfamate, and nickel alkyl sulfonates.

SUMMARY OF THE INVENTION

This invention relates to electroless nickel plating solutions utilizing nickel salts of alkyl sulfonic acids, and to a method of plating substrates utilizing the electroless nickel plating solutions of the invention. The nickel plating solutions of this invention produce acceptable nickel deposits over an extended period of time and at a high plating rate. In particular, the plating baths of the invention exhibit longer plating lives and faster plating rates than conventional electroless nickel electrolytes based on nickel sulfate.

In one embodiment, the aqueous electroless nickel plating solutions of the invention comprise:

(A) a nickel salt of an alkyl sulfonic acid, and (B) hypophosphorous acid or a bath soluble salt thereof selected from sodium hypophosphite, potassium hypophosphite and ammonium hypophosphite, wherein the solution is free of added nickel hypophosphite, and free of alkali or alkaline earth metal ions capable of forming an insoluble orthophosphite.

In yet another embodiment, the aqueous electroless nickel plating solutions of the invention are prepared from:

(A) a nickel salt of an alkyl sulfonic acid, and (B) hypophosphorous acid or a bath soluble salt thereof selected from sodium hypophosphite, potassium hypophosphite and ammonium hypophosphite, wherein the solution is free of added nickel hypophosphite, and free of alkali or alkaline earth metal ions capable of forming an insoluble orthophosphite.

In yet another embodiment, the invention relates to a process for the electroless deposition of nickel on a substrate from a nickel plating solution which comprises contacting the substrate with a solution comprising:

(A) a nickel salt of an alkyl sulfonic acid, and (B) hypophosphorous acid or a bath soluble salt thereof selected from sodium hypophosphite, potassium hypophosphite and ammonium hypophosphite, wherein the solution is free of added nickel hypophosphite, and free of alkali or alkaline earth metal ions capable of forming an insoluble orthophosphite.

In another embodiment, the invention relates to a process for the electroless deposition of nickel on a substrate with a nickel plating solution which comprises:

(A) preparing a nickel plating solution comprising (i) a nickel salt of an alkyl sulfonic acid characterized by the formula

I

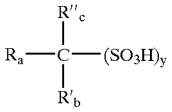

wherein R" is hydrogen, or a lower alkyl group that is unsubstituted or substituted by oxygen, Cl, Br or I, $CF_3$ or $—SO_3H$ R and R' are each independently hydrogen, Cl, F, Br, I, $CF_3$ or a lower alkyl group that is unsubstituted or substituted by oxygen, Cl, F, Br, I, $CF_3$ or $—SO_3H$, a, b and c are each independently an integer from 0 to 3, y is an integer from 1 to 3, and the sum of a+b+c+y=4, and (ii) hypophosphorous acid or a bath soluble salt thereof selected from sodium hypophosphite, potassium hypophosphite and ammonium hypophosphite, wherein the nickel plating solution is free of added nickel hypophosphite, and free alkali or alkaline earth metal ions capable of forming an insoluble orthophosphite, and (B) contacting the substrate with the plating solution prepared in (A).

DESCRIPTION OF THE EMBODIMENTS OF THE INVENTION

In one embodiment, the aqueous electroless nickel plating solutions of the invention comprise:

(A) a nickel salt of an alkyl sulfonic acid, and (B) hypophosphorous acid or a bath soluble salt thereof selected from sodium hypophosphite, potassium hypophosphite and ammonium hypophosphite, wherein the solution is free of added nickel hypophosphite, and free of alkali or alkaline earth metal ions capable of forming an insoluble orthophosphite.

In one embodiment, the alkyl sulfonic acid of the nickel salt may be characterized by the formula

I

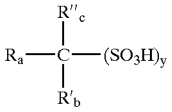

wherein R" is hydrogen, or a lower alkyl group that is unsubstituted or substituted by oxygen, Cl, Br or I, $CF_3$ or $—SO_3H$ R and R' are each independently hydrogen, Cl, F, Br, I, $CF_3$ or a lower alkyl group that is unsubstituted or substituted by oxygen, Cl, F, Br, I, $CF_3$ or —$SO_3H$, a, b and c are each independently an integer from 0 to 3, y is an integer from 1 to 3, and the sum of a+b+c+y=4.

In one embodiment the alkyl sulfonic acid is an alkyl monosulfonic acid or an alkyl disulfonic acid, (i.e., y=1 or 2). In another embodiment, each of the lower alkyl groups R, R' and R' independently contains from 1 to about 4 carbon atoms.

Representative sulfonic acids include the alkyl monosulfonic acids such as methanesulfonic, ethanesulfonic and propanesulfonic acids and the alkyl polysulfonic acids such as methanedisulfonic acid, monochloromethanedisulfonic acid, dichloromethanedisulfonic acid, 1,1-ethanedisulfonic acid, 2-chloro-1,1-ethanedisulfonic acid, 1,2-dichloro-1,1-ethanedisulfonic acid, 1,1-propanedisulfonic acid, 3-chloro-1,1-propanedisulfonic acid, 1,2-ethylene disulfonic acid and 1,3-propylene disulfonic acid.

Because of availability, the sulfonic acids of choice are methanesulfonic acid (MSA) and methanedisulfonic acid (MDSA). In one embodiment of the invention the entire nickel ion content of the electroless nickel plating bath can be supplied in the form of the alkyl sulfonic acid salts.

In the electroless nickel solutions of the invention the operating nickel ion concentration is typically from about 1 up to about 18 grams per liter (g/l). In some embodiments, concentrations of from about 3 to about 9 g/l are utilized. Stated differently, the concentration of nickel cation will be in the range of from 0.02 to about 0.3 moles per liter, or in another embodiment, in the range of from about 0.05 to about 0.1 5 moles per liter.

The nickel alkyl sulfonates which are utilized as the source of nickel cations in the plating solutions of the present invention may be prepared by methods known to those skilled in the art. In one method, a saturated solution of a nickel alkyl sulfonic acid such as nickel methane sulfonate can be prepared at room temperature by dissolving nickel carbonate in MSA. The reaction proceeds as follows:

$$NiCO_3+2CH_3SO_3H \rightarrow Ni(CH_3SO_3)_2+H_2O+2CO_2\uparrow$$

Another chemical process for preparing a nickel alkyl sulfonate involves the reaction of nickel with, e.g., MSA. This reaction proceeds as follows:

$$Ni^o + 2CH_3SO_3H + 1/2O_2 \xrightarrow{heat} Ni(CH_3SO_3)_2 + H_2O$$

A nickel alkyl sulfonate such as nickel methane sulfonate also can be produced by an electrochemical route. The electrochemical route can be represented as follows:

$$Ni^o + 2CH_3SO_3H \xrightarrow{e^-} Ni(CH_3SO_3)_2 + H_2\uparrow$$

The preparation of nickel methane sulfonate from nickel powder by the chemical procedure is illustrated as follows. A mixture is prepared by adding 236 parts by weight of MSA to 208 parts of deionized water, and the mixture is heated to 50° C. Nickel powder (60 parts by weight, is added to the mixture and the mixture is maintained at 60° C. whereupon a slightly exothermic reaction occurs. Accordingly, the nickel powder should not be added too quickly. After all of the nickel powder is added and the exothermic reaction has subsided, oxygen is bubbled through the solution to maintain the reaction, and to raise the pH at the end of the reaction. The pH of the reaction mixture is raised by the excess of nickel and oxygen. After the reaction is completed, and the pH is between 4–5 in the mixer, the flow of oxygen is terminated. The mixture is allowed to cool whereupon excess nickel powder settles to the bottom of the reactor. After settling overnight, the solution is filtered through a 1-micron filter, and thereafter the mixture is circulated through a new 1-micron filter for 6 hours to remove any additional fine nickel material. It is possible to remove the nickel fines from the solution utilizing a magnetic filter, and the recovered nickel fines can be used in another reaction.

In some embodiments, it may be desirable to use purified MSA in the preparation of the nickel salt. Commercially available MSA can be purified by treating with hydrogen peroxide. For example, a mixture of 45 gallons of 70% MSA and 170 grams of 50% hydrogen peroxide is heated at 60° C. for one hour. The mixture is then filtered through activated carbon, and the filtrate is the desired purified MSA.

The nickel plating solutions of the invention also contain, as a reducing agent, hypophosphite ions derived from hypophosphorous acid or a bath soluble salt thereof such as sodium hypophosphite, potassium hypophosphite and ammonium hypophosphite.

The amount of the reducing agent employed in the plating bath is at least sufficient to stoichiometrically reduce the nickel cation in the electroless nickel reaction to free nickel metal, and such concentration is usually within the range of from about 0.05 to about 1.0 moles per liter. Stated differently, the hypophosphite reducing ions are introduced to provide a hypophosphite ion concentration of about 2 up to about 40 g/l, or from about 12 to 25 g/l or even from about 15 to about 20 g/l. As a conventional practice the reducing agent is replenished during the reaction.

It has been suggested in the art that nickel hypophosphite is an efficient way to introduce nickel and hypophosphite to an electroless nickel plating bath since both are consumed, and by-product orthophosphite can be removed by addition of, for example, calcium hydroxide or calcium hypophosphite. However, nickel hypophosphite is not to be used in the preparation of the plating solutions of the present invention since it is desired that the plating solutions be free of nickel hypophosphite and free of alkali or alkaline earth metal ions which are capable of forming an insoluble orthophosphite such as calcium orthophosphite. Thus, the nickel plating solutions of the present invention may be characterized as being free of nickel hypophosphite and free of any added nickel hypophosphite. Also, as noted, the plating solutions of the present invention are free of alkali or alkaline earth metal ions which are capable of forming an insoluble orthophosphite. Examples of such metal ions include lithium ions, calcium ions, barium ions, magnesium ions and strontium ions. In the context of the present invention, the term "free of" is intended to mean that the plating solutions are essentially free of the indicated materials since these materials may be present in very small amounts which do not deleteriously effect the plating solution or the deposited nickel plating. For example, such materials may be present in amounts of less than 0.5 g/l or 500 ppm, or even less than 0.1 g/l or 100 ppm without deleteriously effecting the plating bath or the nickel deposit. Accordingly, as noted above, in one embodiment, nickel hypophosphite is not utilized in the preparation of the nickel plating solutions of the invention nor is nickel hypophosphite added to the plating solutions of this invention. Also, no alkali or alkaline earth metal ions are added to or intentionally included in the plating solutions which are capable of forming an insoluble orthophosphite.

In one embodiment of the present invention, the plating solutions also are free of nickel salts of polyvalent inorganic anions, and in particular, free of nickel salts of inorganic divalent anions. Examples of such nickel salts include nickel sulfate, nickel fluoroborate, nickel sulfonate, and nickel sulfamate. In another embodiment, the plating solutions of the present invention also are free of nickel salts of monovalent inorganic anions such as nickel chloride and nickel bromide.

The plating solutions of the present invention which contain nickel and the phosphorus reducing agents such as hypophosphites or the sodium, potassium or ammonium salts thereof, provide a continuous deposit of a nickel-phosphorus alloy coating on metallic or non-metallic substrates. The phosphorus containing electroless nickel alloy deposits, produced by the process of the present invention, are valuable industrial coating deposits having desirable properties such as corrosion resistance and hardness. High levels of phosphorus, generally above 10%, and up to about 14% by weight, are often desired for many industrial applications such as aluminum memory disks. Such high phosphorus levels may be obtained by conducting the plating operation at a pH of between about 3 to about 5. In another embodiment, the plating operation is carried out at a pH of from about 4.3 to 4.8 to provide an alloy deposit having a high phosphorus content.

In some embodiments, the nickel-phosphorus alloy deposits obtained by the process of the present invention may also be characterized as medium content phosphorus alloys. The medium content phosphorus alloys will have a phosphorus concentration of from about 4 to about 9 weight percent, more often from about 6 to about 9 weight percent. Medium-phosphorus content alloys can be obtained by adjusting the solution composition as well known to those skilled in the art. For example, medium phosphorus containing nickel deposits can be obtained by adding certain acids and stabilizers to the plating solution. In one embodiment, the presence of sulfur based stabilizers such as thiourea results in a medium phosphorus content alloy deposit.

Other materials may be included in the nickel plating solutions of the present invention such as buffers, chelating or complexing agents, wetting agents, accelerators, inhibitors, brighteners, etc. These materials are known in the art.

Thus, in one embodiment, a complexing agent or a mixture of complexing agents may be included in the plating solutions of the present invention. The complexing agents also have been referred to in the art as chelating agents. The complexing agents should be included in the plating solutions in amounts sufficient to complex the nickel ions present in the solution and to further solubilize the hypophosphite degradation products formed during the plating process. The complexing agents generally retard the precipitation of nickel ions from the plating solution as insoluble salts such as phosphites, by forming a more stable nickel complex with the nickel ions. Generally, the complexing agents are employed in amounts of up to about 200 g/l with amounts of about 15 to about 75 g/l being more typical. In another embodiment, the complexing agents are present in amounts of from about 20 to about 40 g/l.

In one embodiment, carboxylic acids, polyamines or sulfonic acids, or mixtures thereof, may be employed as the nickel complexing or chelating agents. Useful carboxylic acids include the mono-, di-, tri-, and tetra-carboxylic acids. The carboxylic acids may be substituted with various substituent moieties such as hydroxy or amino groups and the acids may be introduced into the plating solutions as their sodium, potassium or ammonium, salts. Some complexing agents such as acetic acid, for example, may also act as a buffering agent, and the appropriate concentration of such additive components can be optimized for any plating solution after consideration of their dual functionality.

Examples of such carboxylic acids which are useful as the nickel complexing or chelating agents in the solutions of the present invention include: monocarboxylic acids such as acetic acid, hydroxyacetic acid (glycolic acid) aminoacetic acid (glycine), 2-amino propanoic acid, (alanine); 2-hydroxy propanoic acid (lactic acid); dicarboxylic acids such as succinic acid, amino succinic acid (aspartic acid), hydroxy succinic acid (malic acid), propanedioic acid (malonic acid), tartaric acid; tricarboxylic acids such as 2-hydroxy-1,2,3 propane tricarboxylic acid (citric acid); and tetracarboxylic acids such as ethylene diamine tetra acetic acid (EDTA). In one embodiment, mixtures of 2 or more of the above complexing/chelating agents are utilized in the nickel plating solutions of the present invention.

Examples of polyamines which can be utilized as the complexing or chelating agents in the electroless nickel plating baths of the present invention include, for example, guanidine, dimethyl amine, diethyl amine, dimethyl amino propylamine, tris(hydroxymethyl) amino methane, 3 dimethyl amino-1-propane, and N-ethyl-1,2-dimethyl propyl amine. Examples of sulfonic acids useful as complexing agents include taurine, 2-hydroxy ethane sulfonic acid, cyclohexylaminoethane sulfonic acid, sulfamic acid, etc.

The aqueous electroless nickel plating baths of the present invention can be operated over a broad pH range such as from about 4 to about 10. For an acidic bath, the pH can generally range from about 4 to about 7. In one embodiment, the pH of the solution is from about 4 to about 6. For an alkaline bath, the pH can range from about 7 to about 10, or from about 8 to about 9. Since the plating solution has a tendency to become more acidic during its operation due to the formation of hydrogen ions, the pH may be periodically or continuously adjusted by adding bath-soluble and bath-compatible alkaline substances such as sodium, potassium or ammonium hydroxides, carbonates and bicarbonates. The stability of the operating pH of the plating solutions of the present invention can be improved by the addition of various buffer compounds such as acetic acid, propionic acid, boric acid, or the like, in amounts up to about 30 g/l with amounts of from about 2 to about 10 g/l being typical. As noted above, some of the buffering compounds such as acetic acid and propionoic acid may also function as complexing agents.

The electroless nickel plating solutions of the present invention also may include organic and/or inorganic stabilizing agents of the types heretofore known in the art including lead ions, cadmium ions, tin ions, bismuth ions, antimony ions and zinc ions which can be conveniently introduced in the form of bath soluble and compatible salts such as the acetates etc. Organic stabilizers useful in electroless plating solutions of the present invention include sulfur-containing compounds such as, for example, thiourea, mercaptans, sulfonates, thiocyanates, etc. The stabilizers are used in small amounts such as from 0.1 to about 5 ppm of solution, and more often in amounts of from about 0.5 to 2 or 3 ppm.

The plating solutions of the present invention optionally may employ one or more wetting agents of any of the various types hereto for known which are soluble and compatible with the other bath constituents. In one embodiment, the use of such wetting agents prevents or hinders pitting of the nickel alloy deposit, and the wetting agents can be employed in amounts up to about 1 g/l.

In accordance with the process of the present invention, a substrate to be plated is contacted with the plating solution at a temperature of at least about 40° C. up to the boiling point of the solution. Electroless nickel plating baths of an acidic type are employed, in one embodiment, at a temperature of from about 70° to about 95° C., and more often, at a temperature of from about 80° to about 90° C. Electroless nickel plating baths on the alkaline side generally are operated within the broad operating range but generally at a lower temperature than the acidic electroless plating solutions.

The duration of contact of the electroless nickel solution with the substrate being plated is a function which is dependent on the desired thickness of the nickel-phosphorus alloy. Typically, a contact time can range from as little as about one minute to several hours or even several days. Conventionally, a plating deposit of about 0.2 to about 1.5 mils is a normal thickness for many commercial applications. When wear resistance is desired, thicker deposits can be applied up to about 5 mils.

During the deposition of the nickel alloy, mild agitation generally is employed, and its agitation may be a mild air agitation, mechanical agitation, bath circulation by pumping, rotation of a barrel for barrel plating, etc. The plating solution also may be subjected to a periodic or continuous filtration treatment to reduce the level of contaminants therein. Replenishment of the constituents of the bath may also be performed, in some embodiments, on a periodic or continuous basis to maintain the concentration of constituents, and in particular, the concentration of nickel ions and hypophosphite ions, as well as the pH level within the desired limits.

The following examples illustrate the electroless nickel plating solutions of the invention. Unless otherwise indicated in the following examples, in the written description and in the claims, all parts and percentages are by weight, temperatures are in degrees centigrade and pressure is at or near atmospheric pressure.

EXAMPLE 1

| | |
|---|---|
| Nickel as nickel methane sulfonate | 6 g/l |
| Sodium hypophosphite | 30 g/l |
| Malic acid | 5 g/l |
| Lactic acid | 30 g/l |
| Succinic acid | 5 g/l |
| Lead | 1 ppm |
| Thiourea | 1 ppm |

EXAMPLE 2

| | |
|---|---|
| Nickel as nickel methane sulfonate | 6 g/l |
| Sodium hypophosphite | 25 g/l |
| Malic acid | 20 g/l |
| Lactic acid | 10 g/l |
| Acetic acid | 2 g/l |
| Boric acid | 5 g/l |
| Lead | 1 ppm |

The electroless nickel plating solutions of the present invention may be employed by depositing the nickel alloy on a variety of substrates which may be metal or non-metal substrates. Examples of metal substrates include aluminum, copper or ferrous alloys, examples of non-metal substrates include plastics and circuit boards.

While the invention has been explained in relation to its preferred embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. An aqueous electroless nickel plating solution comprising:

(A) a nickel salt of an alkyl sulfonic acid, and (B) hypophosphorous acid or a bath soluble salt thereof comprising one or more of sodium hypophosphite, potassium hypophosphite and ammonium hypophosphite, wherein the solution is free of added nickel hypophosphite, and free of alkali or alkaline earth metal ions capable of forming an insoluble orthophosphite.

2. The solution of claim 1 wherein the alkyl sulfonic acid is characterized by the formula

I

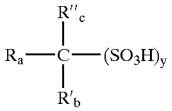

wherein R" is hydrogen, or a lower alkyl group that is unsubstituted or substituted by oxygen, Cl, Br or I, $CF_3$ or —$SO_3H$ R and R' are each independently hydrogen, Cl, F, Br, I, $CF_3$ or a lower alkyl group that is unsubstituted or substituted by oxygen, Cl, F, Br, I, $CF_3$ or —$SO_3H$, a, b and c are each independently an integer from 0 to 3, y is an integer from 1 to 3, and the sum of a+b+c+y=4.

3. The solution of claim 1 wherein the alkyl sulfonic acid is an alkyl monosulfonic acid or an alkyl disulfonic acid.

4. The solution of claim 2 wherein each of the lower alkyl groups R, R' and R" independently contains from 1 to about 4 carbon atoms.

5. The solution of claim 1 wherein the alkyl sulfonic acid is methanesulfonic acid or methane disulfonic acid.

6. The solution of claim 1 also comprising one or more buffers, stabilizers, complexing agents, accelerators, inhibitors or brighteners.

7. The solution of claim 1 which also is free of nickel salts of inorganic polyvalent anions.

8. The solution of claim 1 which is also free of nickel salts of inorganic divalent anions.

9. An aqueous electroless nickel plating solution prepared from:

(A) a nickel salt of an alkyl sulfonic acid, and (B) hypophosphorous acid or a bath soluble salt thereof comprising one or more of sodium hypophosphite, potassium hypophosphite and ammonium hypophosphite, wherein the solution is free of added nickel hypophosphite, and free of alkali or alkaline earth metal ions capable of forming an insoluble orthophosphite.

10. The solution of claim 9 wherein the alkyl sulfonic acid is characterized by the formula

I

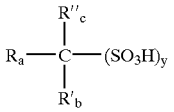

wherein R" is hydrogen, or a lower alkyl group that is unsubstituted or substituted by oxygen, Cl, Br or I, $CF_3$ or —$SO_3H$ R and R' are each independently hydrogen, Cl, F, Br, I, $CF_3$ or a lower alkyl group that is unsubstituted or substituted by oxygen, Cl, F, Br, I, $CF_3$ or —$SO_3H$, a, b and c are each independently an integer from 0 to 3, y is an integer from 1 to 3, and the sum of a+b+c+y=4.

11. The solution of claim 9 wherein the alkyl sulfonic acid is an alkyl monosulfonic acid or an alkyl disulfonic acid.

12. The solution of claim 10 wherein each of the lower alkyl groups of R, R' and R" independently contains from 1 to about 4 carbon atoms.

13. The solution of claim 9 wherein the alkyl sulfonic acid is methanesulfonic acid or methane disulfonic acid.

14. The solution of claim 9 also comprising one or more buffers, stabilizers, chelating agents, accelerators, inhibitors or brighteners.

15. The solution of claim 9 which is also free of nickel salts of inorganic divalent anions.

16. A process for the electroless deposition of nickel on a substrate from a nickel plating solution which comprises contacting the substrate with a solution comprising:

(A) a nickel salt of an alkyl sulfonic acid, and (B) hypophosphorous acid or a bath soluble salt thereof comprising one or more of sodium hypophosphite, potassium hypophosphite and ammonium hypophosphite, wherein the solution is free of added nickel hypophosphite, and free of alkali or alkaline earth metal ions capable of forming an insoluble orthophosphite.

17. The process of claim 16 wherein the alkyl sulfonic acid is characterized by the formula

I

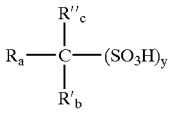

wherein R" is hydrogen, or a lower alkyl group that is unsubstituted or substituted by oxygen, Cl, Br or I, $CF_3$ or —$SO_3H$ R and R' are each independently hydrogen, Cl, F, Br, I, $CF_3$ or a lower alkyl group that is unsubstituted or substituted by oxygen, Cl, F, Br, I, $CF_3$ or —$SO_3H$, a, b and c are each independently an integer from 0 to 3, y is an integer from 1 to 3, and the sum of a+b+c+y=4.

18. The process of claim 17 wherein each of the lower elkyl groups of R, R' and R" independently contain from 1 to about 4 carbon atoms.

19. The process of claim 16 wherein the alkyl sulfonic acid is an alkyl monosulfonic acid or an alkyl disulfonic acid.

20. The process of claim 16 wherein the alkyl sulfonic acid is methanesulfonic acid or methane disulfonic acid.

21. The process of claim 16 wherein the solution also comprises one or more of the following: buffers, stabilizers, chelating agents, accelerators, inhibitors or brighteners.

22. The process of claim 16 wherein the solution also is free of nickel salts of inorganic divalent anions.

23. A process for the electroless deposition of nickel on a substrate with a nickel plating solution which comprises:

(A) preparing a nickel plating solution comprising (i) a nickel salt of methane sulfonic acid or methane disulfonic acid, (ii) hypophosphorous acid or a bath soluble salt thereof comprising one or more of sodium hypophosphite, potassium hypophosphite and ammonium hypophosphite wherein the nickel plating solution is free of added nickel hypophosphite, and free alkali or alkaline earth metal ions capable of forming an insoluble orthophosphite, and (B) contacting the substrate with the plating solution prepared in (A).

24. The process of claim 23 wherein (i) is a nickel salt of methanesulfonic acid.

25. The process of claim 23 wherein the solution prepared in (A) is free of thiourea.

26. The process of claim 23 wherein the plating solution (A) is free of nickel salts of divalent anions.

* * * * *